US010881189B2

(12) United States Patent
Jones et al.

(10) Patent No.: US 10,881,189 B2
(45) Date of Patent: Jan. 5, 2021

(54) CARRY BAG WITH ACTIVATED CARBON AND REMOVABLE PATCH ATTACHMENTS

(71) Applicants: Shamonica S. Jones, Hayward, CA (US); Stephen Harris, Hayward, CA (US)

(72) Inventors: Shamonica S. Jones, Hayward, CA (US); Stephen Harris, Hayward, CA (US)

( * ) Notice: Subject to any disclaimer, the term of this patent is extended or adjusted under 35 U.S.C. 154(b) by 0 days.

(21) Appl. No.: 16/127,977

(22) Filed: Sep. 11, 2018

(65) Prior Publication Data

US 2020/0077771 A1 Mar. 12, 2020

(51) Int. Cl.
*A45F 3/04* (2006.01)
*A45C 13/10* (2006.01)

(52) U.S. Cl.
CPC ..... *A45F 3/042* (2013.01); *A45C 2013/1015* (2013.01)

(58) Field of Classification Search
CPC ..... A45F 3/042; A45F 2003/001; A45F 3/04; A45C 2013/1015; A45C 3/08; A45C 13/08; A45C 3/04; F42B 39/14
USPC ..... 224/153, 901, 645
See application file for complete search history.

(56) References Cited

U.S. PATENT DOCUMENTS

| | | | | |
|---|---|---|---|---|
| 4,861,632 | A * | 8/1989 | Caggiano | B32B 7/02 428/35.2 |
| 2004/0107474 | A1* | 6/2004 | Sesselmann | A41D 13/00 2/69 |
| 2008/0164265 | A1* | 7/2008 | Conforti | B65D 81/3823 220/592.2 |
| 2013/0032502 | A1* | 2/2013 | Anderson | A45C 13/00 206/457 |
| 2015/0129629 | A1* | 5/2015 | Voggenthaler | A45F 3/04 224/645 |

* cited by examiner

*Primary Examiner* — Nathan J Newhouse
*Assistant Examiner* — Matthew T Theis
(74) *Attorney, Agent, or Firm* — Dunlap Bennett & Ludwig, PLLC; Brendan E. Squire

(57) ABSTRACT

A carrying bag with a water resistant Velcro® outer case and an activated carbon inner liner provides an odor proof capability. The Velcro® outer surface provides for user selected placement of one or more removable patch attachments. The invention described here reduces the need to purchase alternative backpacks due to endless user configuration of possible looks. The carry bag may include one or more carry handles and one or more shoulder straps.

19 Claims, 3 Drawing Sheets

CARRY BAG WITH ACTIVATED CARBON AND REMOVABLE PATCH ATTACHMENTS

BACKGROUND OF THE INVENTION

The present invention relates carry bags, such as backpacks, and more particularly to user designable carry bags.

Backpacks are often disposed of prematurely, that is before the end of their useful service life, due to changes in design popularity and style and the user simply wanting the next new style. As one grows so does their taste and style in luggage. Because most backpacks have a fixed look, the user is therefore is either forced to spend more money on a backpack to accommodate a look or style change, or to keep the same backpack year around.

Other backpacks and carry bags allow odors to seep out, particularly when they are utilized as a gym bag to carry sweaty clothes.

As can be seen, there is a need for an improved carry bag that allows the user to redesign the backpacks to achieve many possibilities of looks and one that provides an odor containing compartment.

SUMMARY OF THE INVENTION

In one aspect of the present invention a carry bag is disclosed. The carry bag includes a main compartment having a plurality of sidewalls defining an interior compartment and a closure to selectively open and close an opening to the interior compartment. The plurality of sidewalls is defined by a multi-layer structure. An outer layer is formed of one of a hook and a loop material adapted to removably receive one or more decorative patches. The patches are adhered to the outer layer by a cooperating hook and loop material applied to a back surface of the patch. A water resistant layer is disposed subjacent to the outer layer. A carbon activated liner is positioned subjacent to the water resistant layer, and a fabric liner is disposed between the carbon activated liner and the interior compartment.

In some embodiments, the carrying bag includes at least one carrying handle extending above a top end of the main compartment. In other embodiments, at least one shoulder strap is attached between a top end of the carry bag and a bottom end of the carry bag. The at least one shoulder strap may include a pair of shoulder straps oriented in a backpack configuration.

In preferred embodiments, the carbon activated liner includes a first and a second carbon activated layer. An enclosure contains the first and the second carbon activated layers. The enclosure may be formed of a first paper layer and a second paper layer.

In other embodiments, the carry bag may include one or more auxiliary compartments attached to an exterior of the main compartment. A zipper closure may extend across an opening to the one or more auxiliary compartments. In some embodiments, the closure includes a zipper. More preferably, the closure is a rubber sealed zipper.

These and other features, aspects and advantages of the present invention will become better understood with reference to the following drawings, description and claims.

DETAILED DESCRIPTION OF THE INVENTION

Figure 3:
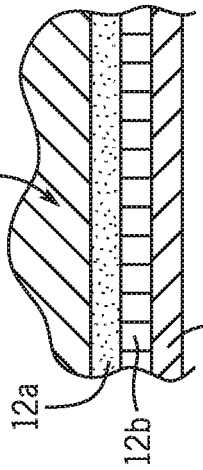
FIG. 3 is a detail cross-sectional view taken on line 3-3 of FIG. 1.
Figure 2:
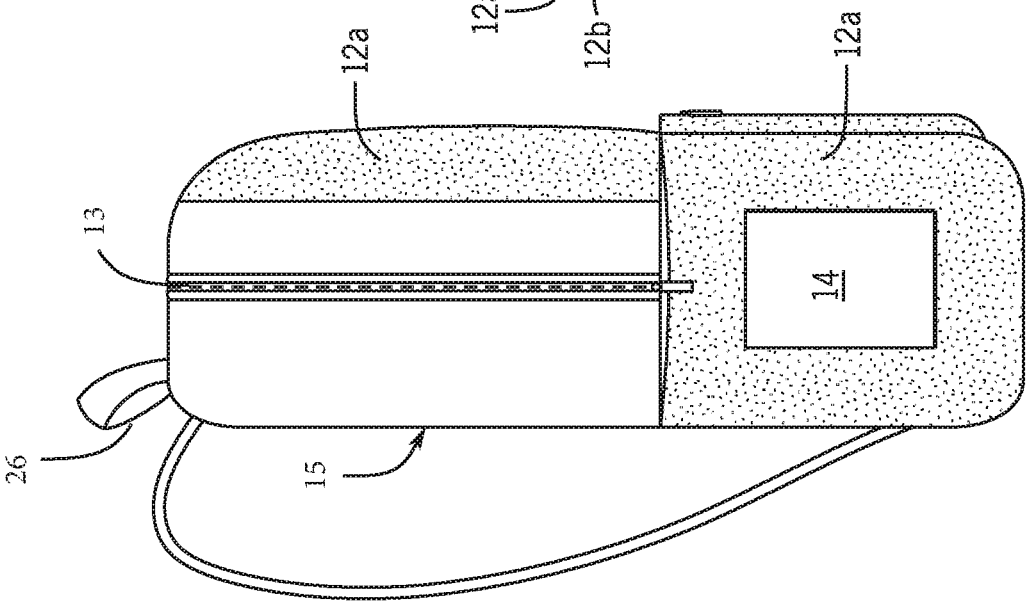
FIG. 2 is a side elevation view of the carry bag.
Figure 1:
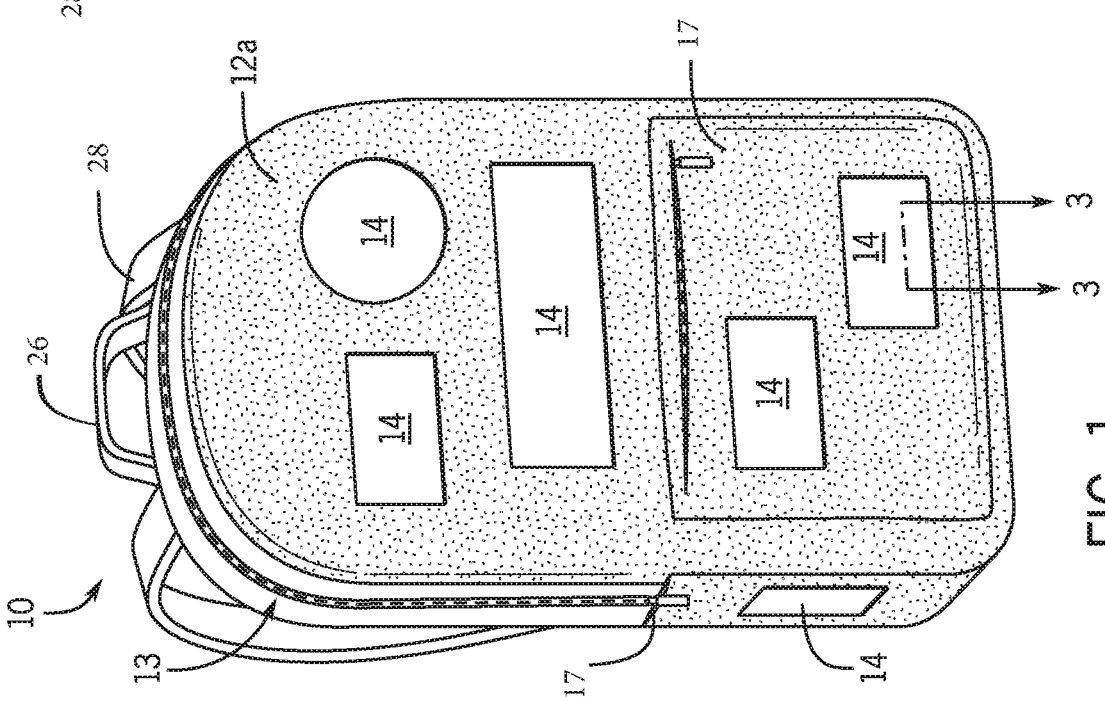
FIG. 1 is a front perspective view of an embodiment of a carry bag with activated carbon & removable patch attachments in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention carry bag with activated carbon & removable patch attachments invention. The activated carbon serves to contain odors of materials carried within the bag while the outer surface of the bag is configured to removably receive one or more patches so that the user can redesign the look of the bag as their tastes and preferences change. A waterproof or water resistant liner keeps an interior compartment of the carry bag dry.

As seen in reference to the drawings of FIGS. 1-6, the carry bag 10 includes an outer layer 12*a* that is formed from one of a hook and loop fastener material. The outer layer 12*a* is configured to removably secure a patch 14 having a back surface with a cooperating layer 12*b* of hook and loop fastener material. The user may thus place one or more patches 14 to any region of the outer layer 12*a* that they desire. The patches may be selected from any number of sources so that the user may customize their bag and adapt the bag's appearance as their tastes and preferences change over time. By way of non-limiting example, a youngster may apply patches that are popular or age appropriate. As the user ages, they may change the patches to more age appropriate patches as their interests grow over time. In other instances, the user may be on a backpacking adventure across Europe and may collect a series of patches commemorating the places they visit on their journey.

Beneath the outer layer, a layer of water resistant material 16 is provided to keep the interior of the carry bag 10 dry. The water resistant layer 16 may be of any suitable material, and is preferably a polyester material 15.

Figure 5:
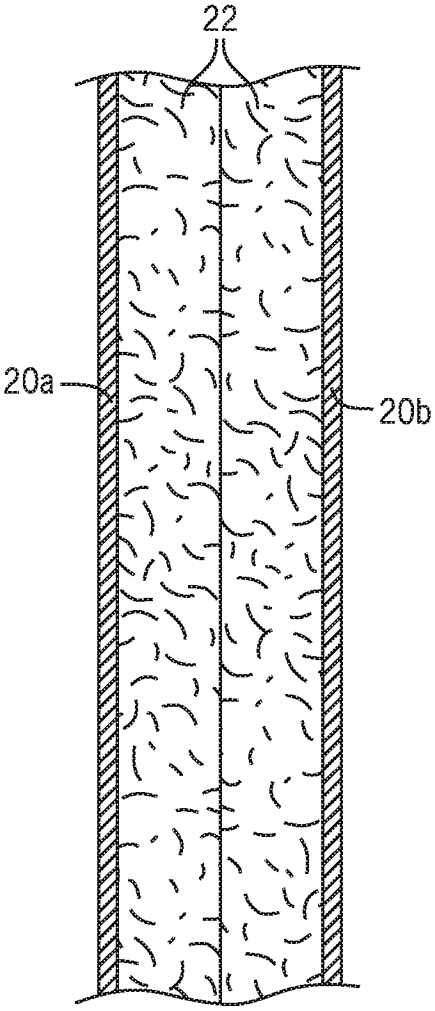
FIG. 5 is a cross-sectional view taken on line 5-5 of FIG. 4.
Figure 4:
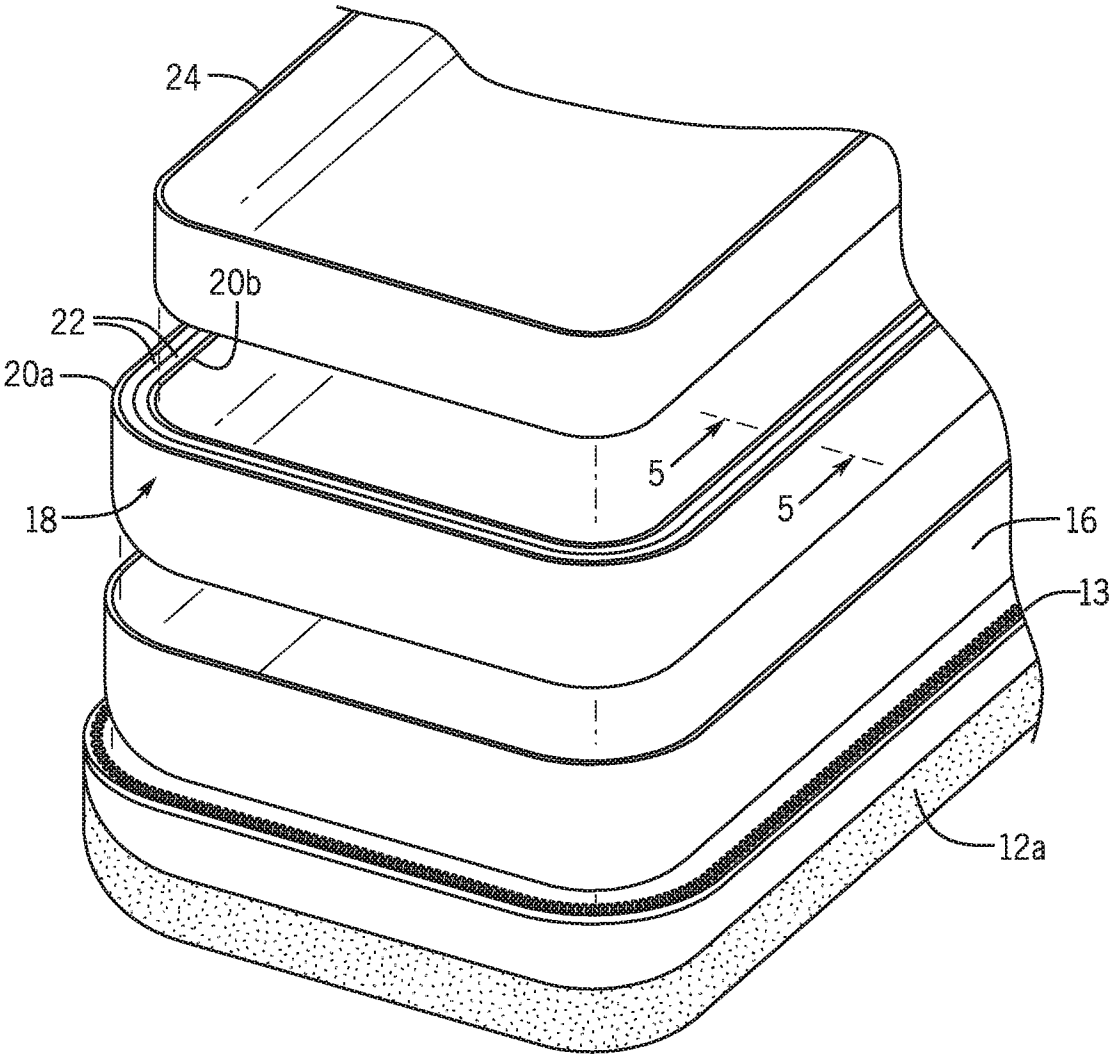
FIG. 4 is a detail perspective view with parts broken away.
Figure 6:
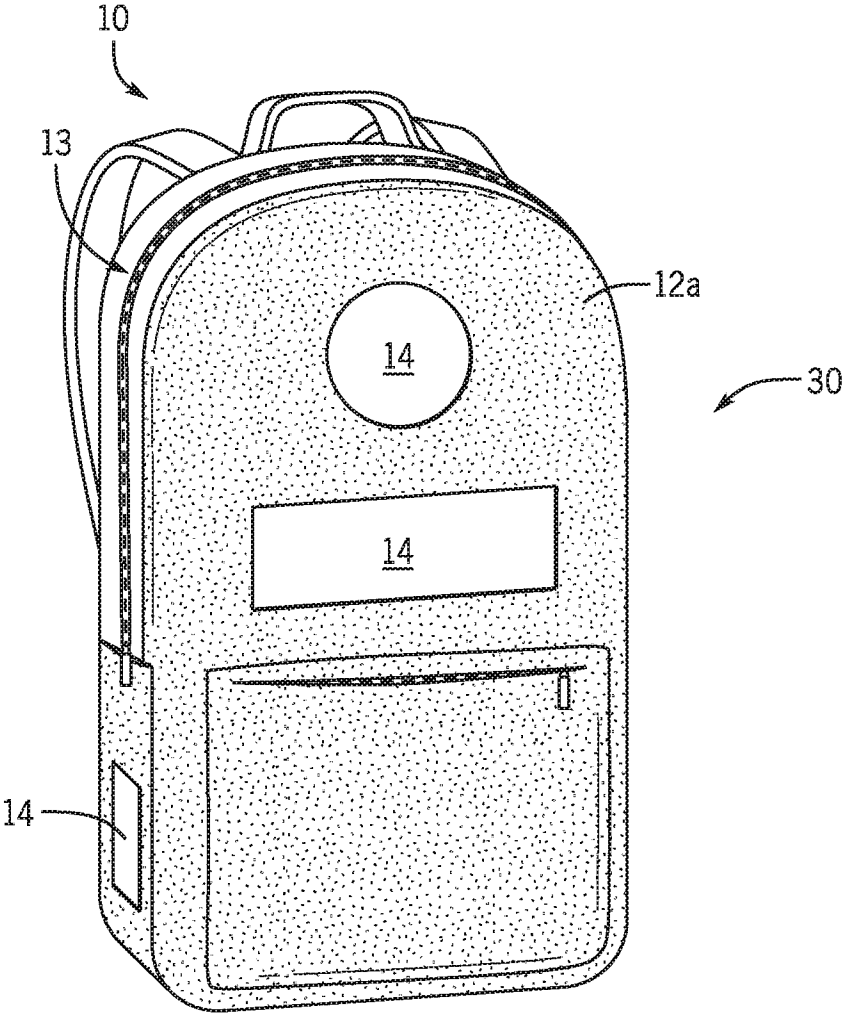
FIG. 6 is a front perspective view, similar to FIG. 1, showing alternate positioning of the patches.

As best seen in reference to FIG. 5, an activated carbon liner 18 is provided beneath the water resistant layer 16. The activated carbon liner 18 may include at least one, and more preferably a two layers of activated carbon 22. The at least one activated carbon layer 22 is contained within an enclosure, which may be formed of a first paper layer 20*a* and a second paper layer 20*b*. The activated carbon layers 22 act as a sponge that captures odor-causing vapors and takes them out of circulation. As will be appreciated, while the carbon liner 18 may contain odors within the main compartment, it may also serve to keep clean and fresh items contained therein from spoilage or contamination from external vapor sources.

Beneath the activated carbon liner 18, an interior fabric liner 24, such as polyester or nylon liner 24 is provided to protect the activated carbon liner 18 and to protect the interior compartment of the carry bag 10 from carbon materials that may be released from the carbon liner 18. The water resistant layer 16, carbon liner 18, and the interior fabric liner 24 may be sewn or joined with the outer layer 12*a* to provide a water resistant and odor resistant interior cavity of the carry bag 10.

The carry bag 10 may include a main compartment 15 with a zipper 13 closure to access an interior compartment of the bag 10. Preferably the closure 13 includes a rubber sealed zipper to preclude water from infiltrating the interior compartment. With the foregoing layers, the interior compartment is both water resistant and odor containing. The carrying bag 10 may include at least one carrying handle 26 extending above a top end of the bag 10. Preferably, the carry bag 10 includes at least one shoulder strap 28 so that the carrying bag 10 may be worn as a backpack.

The carry bag 10 may also include one or more auxiliary compartments 17, which may include a zipper 13 closure, or may be formed as a pouch that is accessible from the exterior of the bag 10.

It should be understood, of course, that the foregoing relates to exemplary embodiments of the invention and that modifications may be made without departing from the spirit and scope of the invention as set forth in the following claims.

What is claimed is:

1. A carry bag, comprising:

a main compartment having a plurality of sidewalls defining an interior compartment and a closure to selectively open and close an opening to the interior compartment;

the plurality of sidewalls defined by a multi-layer structure, comprising:

an outer layer formed of one of a hook and a loop material adapted to removably receive one or more decorative patches adhered to the outer layer by a cooperating hook and plie material applied to a back surface of the patch;

a water resistant layer subjacent to the outer layer;

an activated carbon liner subjacent to the water resistant layer, the activated carbon liner having at least one activated carbon layer sandwiched between a first material layer and a second material layer forming an enclosure about the activated carbon layer; and a fabric liner disposed between the activated carbon liner and the interior compartment.

2. The carrying bag of claim 1, further comprising:

at least one carrying handle extending above a top end of the main compartment.

3. The carrying bag of claim 1, further comprising:

at least one shoulder strap attached between a top end of the carry bag and a bottom end of the carry bag.

4. The carrying bag of claim 3, wherein the at least one shoulder strap includes a pair of shoulder straps oriented in a backpack configuration.

5. The carrying bag of claim 1, wherein the carbon activated liner further comprises:

a first and a second activated carbon layer; and the enclosure containing the first and the second carbon activated layers.

6. The carrying bag of claim 5, wherein the first material layer and the second material layer are formed of a first paper layer and a second paper layer.

7. The carrying bag of claim 1, further comprising:

one or more auxiliary compartments attached to an exterior of the main compartment.

8. The carrying bag of claim 7, further comprising:

a zipper closure across an opening to the one or more auxiliary compartments.

9. The carrying bag of claim 1, wherein the closure comprises a zipper.

10. The carrying bag of claim 9, wherein the closure further comprises:

a rubber sealed zipper.

11. A carry bag, comprising:

a main compartment having a plurality of sidewalls defining an interior compartment and a closure to selectively open and close an opening to the interior compartment;

the plurality of sidewalls defined by a multi-layer structure, comprising:

an outer layer formed of one of a hook and a loop material adapted to removably receive one or more decorative patches adhered to the outer layer by a cooperating hook and plie material applied to a back surface of the patch;

a water resistant layer subjacent to the outer layer;

an activated carbon layer enclosed within an enveloping layer, defining an activated carbon liner, the activated carbon liner positioned subjacent to the water resistant layer; and a fabric liner disposed between the activated carbon liner and the interior compartment.

12. The carrying bag of claim 11, further comprising:

at least one carrying handle extending above a top end of the main compartment.

13. The carrying bag of claim 11, further comprising:

at least one shoulder strap attached between a top end of the carry bag and a bottom end of the carry bag.

14. The carrying bag of claim 13, wherein the at least one shoulder strap includes a pair of shoulder straps oriented in a backpack configuration.

15. The carrying bag of claim 11, wherein the carbon activated liner further comprises:

a first and a second activated carbon layer; and the enveloping layer containing the first and the second carbon activated layers.

16. The carrying bag of claim 11, wherein the closure comprises a zipper.

17. The carrying bag of claim 16, wherein the closure further comprises:

a rubber sealed zipper.

18. A carry bag, comprising:

a main compartment having a plurality of sidewalls defining an interior compartment and a closure to selectively open and close an opening to the interior compartment;

the plurality of sidewalls defined by a multi-layer structure, comprising:

an outer layer;

a water resistant layer subjacent to the outer layer;

an activated carbon liner consisting of a layer of activated carbon sandwiched between a first paper layer and a second paper layer, the activated carbon liner positioned subjacent to the water resistant layer; and a fabric liner disposed between the activated carbon liner and the interior compartment.

19. The carry bag of claim 18, wherein the outer layer further is formed of one of a hook and a loop material adapted to removably receive one or more decorative patches adhered to the outer layer by a cooperating hook and loop material applied to a back surface of the patch.

* * * * *